United States Patent [19]

Arp

[11] Patent Number: 4,827,545

[45] Date of Patent: May 9, 1989

[54] REMOVABLE PROTECTIVE COVERING ASSEMBLY FOR A BED RESTRAINING SIDE RAIL

[76] Inventor: Norman T. Arp, 1025 South Prospect, Tacoma, Wash. 98405

[21] Appl. No.: 165,723

[22] Filed: Mar. 9, 1988

[51] Int. Cl.[4] ..... A47C 21/08

[52] U.S. Cl. ..... 5/424; 5/425

[58] Field of Search ..... 5/424, 425, 482, 93 R, 5/427, 428; 248/345.1

[56] References Cited

U.S. PATENT DOCUMENTS 4,704,750 11/1987 Wheelock ..... 5/200 R

*Primary Examiner*—Alexander Grosz

*Attorney, Agent, or Firm*—Roy E. Mattern, Jr.

[57] ABSTRACT

A protective covering assembly for removable placement over a bed restraining side rail, made of spaced members, has lengths of preformed pipe insulation, cut and fitted about the spaced members, to provide surrounding padding for them. Thereafter, sheets of heavy duty plastic upholstery are cut, sewn, and fitted up, across, down, and under, the padded bed restraining side rail, as an envelope, to provide a surrounding, restraining, easily cleaned, protective covering. Then to provide for the removal of the covering assembly, an openable fastening assembly is secured to the plastic upholstery, which when opened, serves to clear the envelope from the padded space members of the restraining side rails, during their relative movement.

1 Claim, 2 Drawing Sheets

FIG. 4
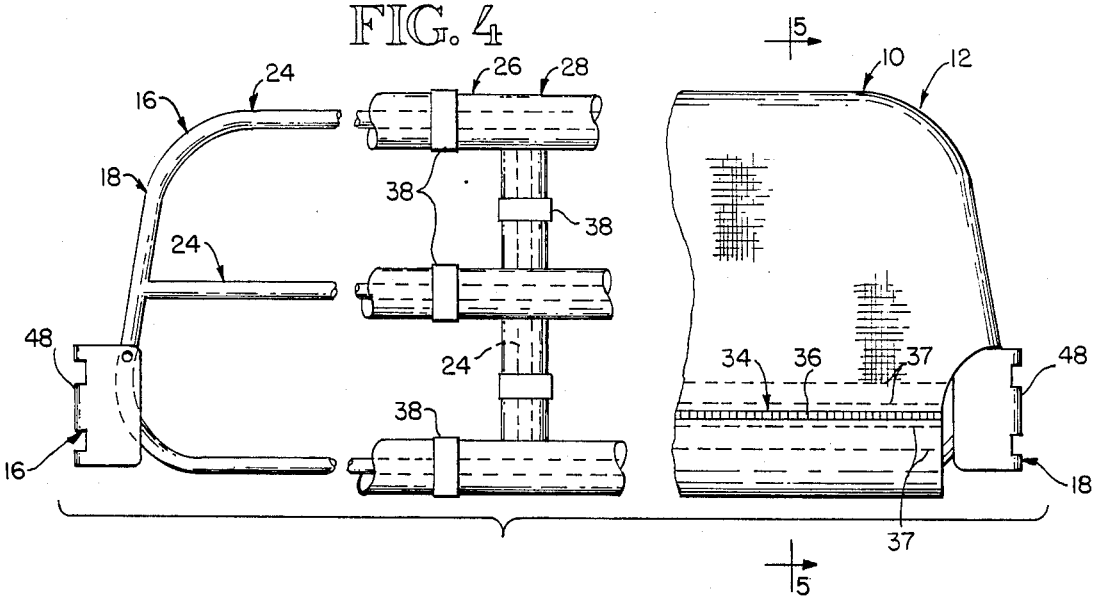
FIG. 5
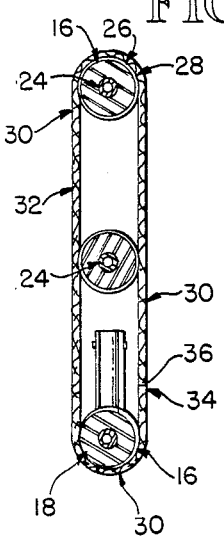
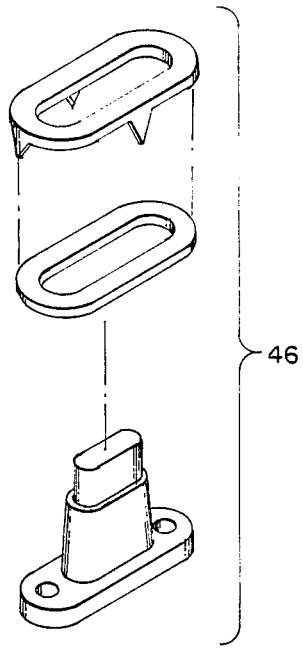
FIG. 6

REMOVABLE PROTECTIVE COVERING ASSEMBLY FOR A BED RESTRAINING SIDE RAIL

BACKGROUND

In reference to beds having side rails to keep persons in bed during their possible restlessness, which might otherwise cause them to fall out of bed if there were no restraining side rails, there have been previous covers provided for these restraining side rails, some of which have been padded.

Margie I. Clark in her U.S. Pat. No. 3,742,530 of 1973, illustrates and describes her bedside rail cover, made of opaque material, such as plastic, quilted cotton, stretch fabric, or double-knit fiber, which is readily washable. The inner portion of her bedside rail cover, for placement adjacent the person in the bed, is about twice as wide as the outer portion, which is folded back against the inner portion and secured by fasteners in the middle and at the ends, over an intermediate brace, i.e. a spaced member, of the restraining bedside rail. She does not first place padding over the spaced members of the side rails.

Patsie Mahoney, in her U.S. Pat. No. 4,215,446 of 1980, in respect to a different type of hospital bed side rail, describes and illustrates how she provides two panels of padded material of a shape similar to the appropriate bed rail, and of a size sufficient to completely cover and enclose the bed rail. Her two panels are hinged together at the top for their movement, between an open, spaced apart relationship, and a closed, coplanar relationship, enclosing the restraining bed rail. Then detachable fasteners are located along the lower edges of the panels, for detachably fastening the two panels on the bed rail. She does not first place padding over the spaced members of the side rails.

Gloria C. Webber, in her U.S. Pat. No. 4,370,765 of 1983, describes and illustrates her envelope and flap, made of a net-like plastic or nylon, which is strong, durable, and washable. The envelope portion slides down over the restraining side rail of a bed, and the flap portion extends under a mattress across the top of a mattress supporting member and is secured thereto. Her envelope and flap, when placed over a bed rail and fully positioned and secured, keep a person in a bed and prevents portions of his or her body from extending between the rails and between the side rail and the mattress. She does not first place padding over the spaced members of the side rails.

Protective cushions for side rails of a bed and within a bed are provided by Donald C. Spanns as illustrated and described in his U.S. Pat. No. 4,214,326 of 1980. In reference to his cushion placeable over the top spaced member, it is not thereafter covered by a protective cover.

Michael F. Petock, in his U.S. Pat. No. 3,884,495 of 1975, describes and illustrates his design of a child's walker.

To protect furniture in a home from being damaged, as a child, learning to walk, moves his or her stroller or walker around the home, portions of the stroller are padded. A resilient material is placed around a support member, such as a leg of a stroller. The resilient material is of a foam type, such as foam rubber, foam polystyrene, or foam polyurethane. Thereafter, the resilient material is covered using a canvas, natural or synthetic fabric, synthetic resin flexible plastic material, or any other suitable cleanable material, synthetic or natural. The covering is provided with fasteners, such as snap fasteners, clasps, or other fasteners, which are well known.

SUMMARY

This protective covering assembly for removable placement over a bed restraining side rail, made of spaced members, protects bed occupants or bed patients during their sleep, when often they cannot control themselves, and/or they do not realize the significance of their movements, particularly the restless or confused, elderly, physically handicapped, and/or mentally ill persons. The very well padded spaced members, often of pipe configurations, covered with pipe insulation, so well cushion any portion of a person's body that strikes the padded spaced members, that the occupant of the bed will not suffer any injury.

Moreover, the surrounding, restraining, easily cleaned, protective covering keeps the portions of a person's body over the mattress, not allowing any portions to partially or fully pass through the spaces between the spaced members of the bed restraining side rail. The protective covering, preferably made of a plastic upholstery such as naugahyde, adds to the overall cushioning protection of portions of a person's body.

The overall completeness of the protective covering assembly insures the completeness of the daily cleaning operations. Yet when this assembly must be removed, the preferred zipper fastener assembly is quickly operated to create the clearance necessary for the relative separating movement of the protective covering assembly, as an envelope, from the padded space members of the bed restraining side rails. Installation of this protective covering assembly does not interfere with the normal raising and lowering of the bed restraining side wall, by any person assisting the person who is confined to bed.

DESCRIPTION OF THE DRAWINGS

The protective covering assembly for removable placement over a bed restraining side rail, made of spaced members, is illustrated in the drawings, wherein:

FIG. 4 is an enlarged side view of the embodiment shown in FIGS. 1 and 2, having portions removed, to illustrate: commencing at the left, the unpadded and uncovered spaced members of the restraining side rails; then in the center, the padded and otherwise uncovered spaced members, indicating the use of adhesive tape when necessary, and terminating at the right, the padded and covered spaced members;

FIG. 5 is a cross-sectional view taken on line 5—5 of FIG. 4, illustrating the spaced members of the restraining side rail, the padding fitted around them, i.e. the pipe insulation fitted about these pipe sized spaced members; the surrounding, restraining, easily cleaned, protective covering, i.e. the covering made of heavy duty plastic upholstery, such as naugahyde upholstery; and the openable fastening assembly, i.e. the zipper fastening assembly; and FIG. 6 is an exploded view of a marine type fastener used as the fastening assembly.

DESCRIPTION OF THE PREFERRED EMBODIMENTS

Figure 1:
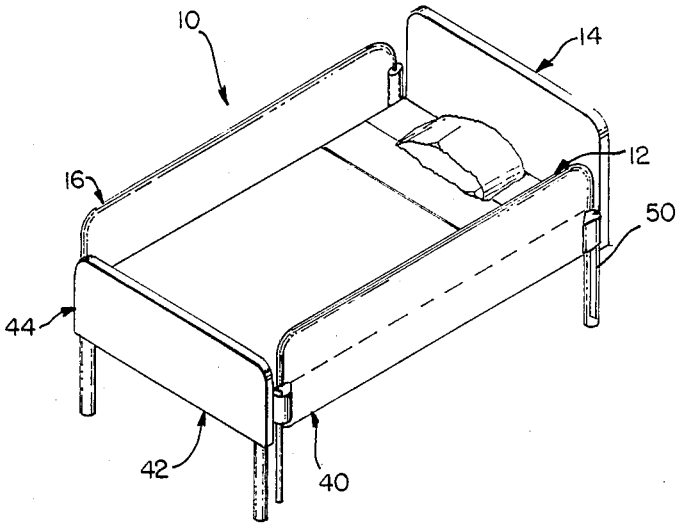
FIG. 1 is a perspective view illustrating how two protective covering assemblies are removably placed over respective bed restraining side rails of a bed, showing them in their raised restraining positions, and with dotted lines indicating a lower position of one of them.
Figure 2:
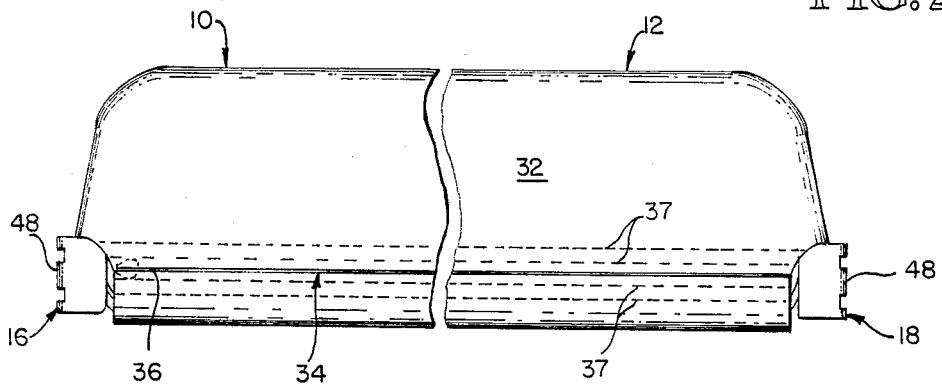
FIG. 2 is a side view of one embodiment of the protective covering assembly fitted over one embodiment of a bed restraining side rail.
Figure 3:
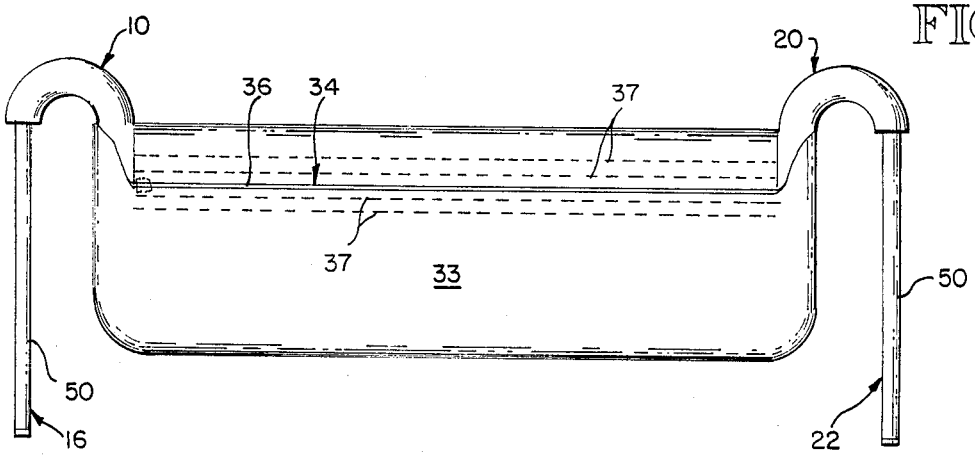
FIG. 3 is a side view of another embodiment of the protective covering assembly fitted over another embodiment of a bed restraining side rail.

The protective covering assembly 10, in one embodiment 12, is shown in FIGS. 1, 2, 4, and 5, on a bed 14, for removable placement over a bed restraining side rail 16, of one embodiment 18. The protective covering assembly 10, in another embodiment 20, is shown in FIG. 3, for removable placement over a bed restraining side rail 16, of another embodiment 22.

As illustrated in FIG. 4, in the left area, portions of the spaced members 24 of the bed restraining side rail 16, of embodiment 18, are shown as they appear before being covered by the protective covering assembly 10 of embodiment 12. In the central area of FIG. 4, the spaced members 24 of the bed restraining side rail 16, are illustrated, as they appear when covered by a padding 26, which is generally derived from hollow cylindrical pieces of pipe insulation 28, generally made of foamed plastic materials. In the right area of FIG. 4, the spaced members 24 of the bed restraining side rail 16, and the covering padding 26 thereof are shown covered by a surrounding, restraining, easily cleaned, protective covering 30, such as a plastic material, for example, naugahyde 32. This surrounding protective covering 30 has a fastening assembly 34, preferably a zipper 36. When the zipper 36 is opened, the surrounding, restraining, easily cleaned protective covering or cover 30, is removed upwardly to clear the padded bed restraining rail 16. After major cleaning or repair, this protective cover 30 is moved downwardly to pass over and around the padded bed restraining rail 16, and then the zipper 36 is closed. Daily cleaning is undertaken without removing this protective cover 30. As shown in FIGS. 2, 3, and 4, very thorough strong stitching threads 37 are used by the zipper 36 and elsewhere at seams and edges to insure the long active life of this protective cover 30.

As necessary, portions of an adhesive tape 38 are placed circumferentially and/or longitudinally to maintain the positioning of the pipe insulation padding 26. Also plastic cements may be used on abutting portions of the pipe insulation 28.

When a protective covering assembly 10 is in place, and the covered bed restraining rail 16 is up on one side 40 of a bed 14, often a hospital bed 42, and another bed restraining rail 16, having a protective covering assembly 10 in place is in an up position on the other side 44 of a bed 14, especially a hospital bed 42, then any person sleeping in this bed will not be injured, when portions of his or her body strike or rub against the covered bed restraining rails 16, covered by this protective covering assembly 10.

As shown in FIG. 6, other fastening assemblies may be utilized such as the three piece marine fastener assembly 46 often used in securing boat, car, and truck canopies.

Resilient materials which may be utilized are neoprene foam rubber, foam polystyrene, foam polyurethane. However, all materials used must meet medical standards and fire codes.

In FIG. 2, the sliding guides 48 of the bed restraining rail 16 of one embodiment 18 are illustrated. In FIG. 3, the sliding rods 50 of the bed restraining rail 16 of another embodiment 22 are illustrated. These components 48, 50 are utilized when the respective bed restraining rails 16 are raised and lowered.

The materials selected for using in the protective covering assembly 10 are selected: to meet fire codes; be anti-static; have a slip surface; be mildew resistant; be sulfide stain resistant; be oil resistant; be of commercial grade; be noncorrosive in reference to the zipper or other selected fastener assemblies; be fire retardant having a flame spread rating of 25 or less; and a smoke producing rating of 50 or less.

This resulting protective covering assembly 10, attains higher protection advantages than any previous covering assembly, in respect to providing care for those persons who must spend confining times in beds.

I claim:

1. In combination with a bed having a side guard on at least one of its sides, said side guard comprised of a plurality of elongate, generally cylindrical, intersecting side pipe rails that are adapted to move up and down, relative to the bed, as a unit, an easily removable protecting covering assembly adapted to protect a user of the bed from harmful contact with the uncovered side pipe rails, comprising:

(a) commercially available lengths of readily available hollow cylinder preformed plastic foamed pipe insulation of selected commercially available inside diameters of a size to closely receive exterior cylindrical surfaces of the up and down movable side pipe rails, each length of pipe insulation radially cut to lengths to match the lengths of these pipe rails, and longitudinally cut, via one straight cut per length, to enable the placement of this cut length about a selected pipe rail;

(b) commercially available lengths of adhesive backed tape cut to selected lengths, to enable their placement at selected spaced locations to hold the cut lengths of the preformed plastic foamed pipe insulation in place about the respective pipe rails of the up and down movable side pipe rails;

(c) commercially available heavy duty naugahyde upholstery cut to a selected size to substantially completely surround the up and down movable side pipe rails, after their complete covering with the preformed plastic foamed pipe insulation, held in place by the spaced adhesive backed tape, and to leave a longitudinal arrangement of closely spaced parallel edges of this naugahyde upholstery at a location on an outside of the sideguard, clear of any possible contact with a patient who is in bed; and (d) a commercially available arrangement of a fastening subassembly, such as a zipper assembly, for installation along the closely spaced parallel edges of the naugahyde to secure them together during the installation of the protective covering assembly over the up and down movable side pipe rails, and to release them during the installation or removal of the protective covering assembly over the up and down movable side pipe rails.

* * * * *